US005864079A

United States Patent [19]

Matsuda

[11] Patent Number: 5,864,079

[45] Date of Patent: Jan. 26, 1999

[54] TRANSPOSITION CONTROLLER FOR AN ELECTRONIC MUSICAL INSTRUMENT

[75] Inventor: Toshinori Matsuda, Hamamatsu, Japan

[73] Assignee: Kabushiki Kaisha Kawai Gakki Seisakusho, Shizuoka-ken, Japan

[21] Appl. No.: 859,740

[22] Filed: May 21, 1997

[30] Foreign Application Priority Data

May 28, 1996 [JP] Japan ..... 8-156265

[51] Int. Cl.[6] ..... G10H 1/02

[52] U.S. Cl. ..... 87/619; 84/631; 84/657; 84/664; 84/DIG. 4

[58] Field of Search ..... 84/619, 631, 477 R, 84/609–614, 634–638, 657, 664, 478, 385, 708

[56] References Cited

U.S. PATENT DOCUMENTS 4,744,281 5/1988 Isozaki ..... 84/DIG. 4
4,941,387 7/1990 Williams et al. ..... 84/619 X
5,281,754 1/1994 Farrett et al. ..... 84/619 X
5,561,256 10/1996 Aoki et al. ..... 84/619 X
5,612,501 3/1997 Kondo et al. ..... 84/657 X
5,623,112 4/1997 Ito et al. ..... 84/610 X

*Primary Examiner*—Stanley J. Witkowski
*Attorney, Agent, or Firm*—Hill & Simpson

[57] ABSTRACT

An electronic musical instrument has a means used by a player to set a key name to which transposition is to be made and a part number to designate a transposition excluding part. Tone data in parts other than the transposition excluding part are exclusively subjected to transposition processing, and transposed tones are produced. For example, play data of a keyboard are set as a transposition excluding part, and their tones are produced in C major key as the key played. On the other hand, the keys of accompanying tones such as chord tones, rhythm tones, and the like programmed in keys other than C major key in a storage medium are transposed to C major key to produce transposed tones, allowing an ensemble play in common key.

7 Claims, 7 Drawing Sheets

TRANSPOSITION CONTROLLER FOR AN ELECTRONIC MUSICAL INSTRUMENT

BACKGROUND OF THE INVENTION

1. Field of the Invention

The present invention relates to a transposition controller for an electronic musical instrument and, for example, a transposition controller suitably used in an electronic musical instrument which comprises an auto-play unit and can execute an ensemble play.

2. Description of the Related Art

Conventionally, an auto-play unit which records data played by the player in a recording medium and automatically reads out and plays back the recorded play data in accordance with the player's instructions is known. In an electronic musical instrument comprising an auto-play unit of this type, a plurality of concurrent tone generation channels are assigned to a plurality of play parts, and when the player plays a given part with a keyboard while playing back auto-play data, an ensemble play can be realized.

Upon executing such an ensemble play, when the auto-play data is played back to have a chord other than a C chord as a tonic chord, i.e. when the auto-play data was recorded in a key other than the C major key, the player must play the keyboard in the key matched to that of the auto-play data. However, it is generally difficult, especially for a beginner, to play in a key other than the C major key.

Some electronic musical instruments can automatically transpose and generate tones by setting desired transposition information. Therefore, by utilizing this transposition function, even when auto-play data was recorded in a key other than the C major key, the auto-play data can be transposed and played back in the C major key, so that the player can play the keyboard in easy C major key matched to the transposed auto-play data.

However, since the conventional electronic musical instrument transposes the entire parts if the transposition information is set, the keyboard part is undesirably transposed, too. For this reason, even when the player plays the keyboard part in the C major key in correspondence with the key of the transposed auto-play data, since note data (play data) from the keyboard itself is transposed, the key of auto-play part and the key of the keyboard part become different from each other.

SUMMARY OF THE INVENTION

The present invention has been made to solve such problems and has as its object to allow even a beginner to perform an ensemble play in common key independently of the key of auto-play data upon recording.

According to the present invention, a transposition controller for an electronic musical instrument, which has tone generation channels corresponding to a plurality of parts to attain an ensemble play, comprises transposition data set means for setting transposition data for tone data of the individual parts; part set means for selecting at least one part which is not to be transposed from the plurality of parts; and transposition control means for exclusively performing transposition data processing for the tone data of the parts to be transposed on the basis of the part data set by the part set means and the transposition data set by the transposition data set means.

Tones can be produced while transposing play parts other than the play part desired by the player. For example, the tone data to be generated by the auto-play data can be transposed, but the tone data to be produced by the keyboard operation of the player can be inhibited from being transposed.

DETAILED DESCRIPTION OF THE PREFERRED EMBODIMENTS

An embodiment of the present invention will be described hereinafter with reference to the accompanying drawings.

Figure 1:
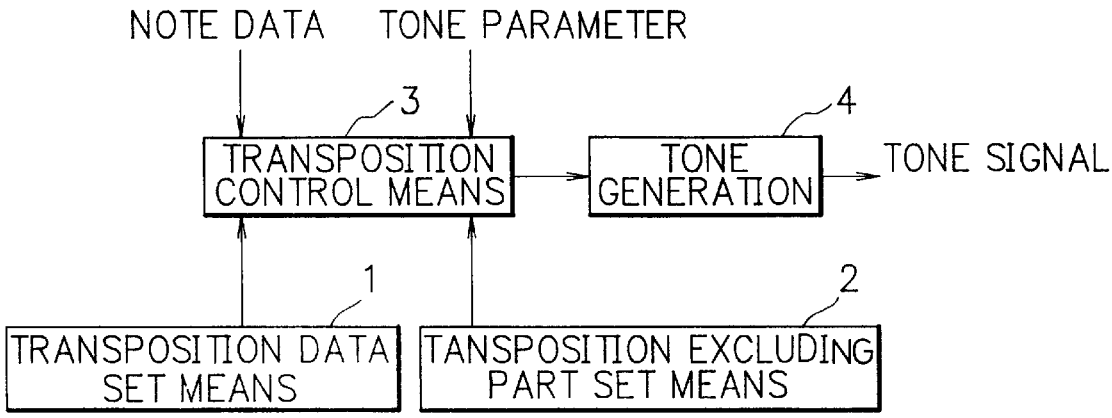
FIG. 1 is a functional block diagram showing the elementary features of a transposition controller for an electronic musical instrument according to the present invention.
Figure 2:
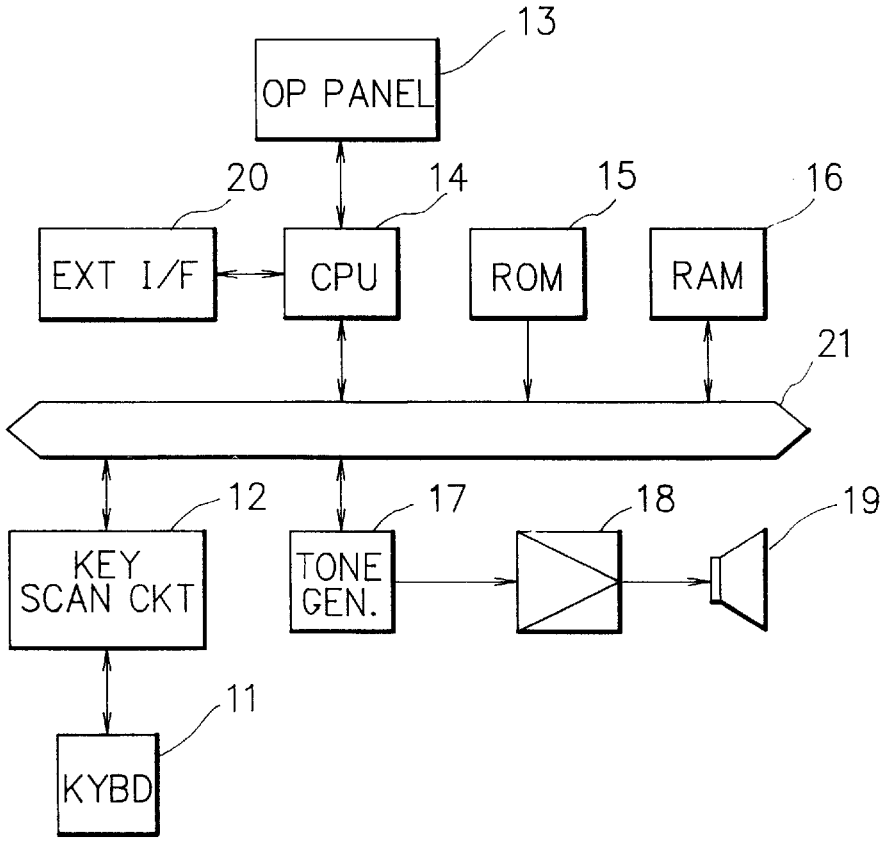
FIG. 2 is a schematic block diagram showing the arrangement of the overall electronic musical instrument to which the present invention is applied.
Figure 3:
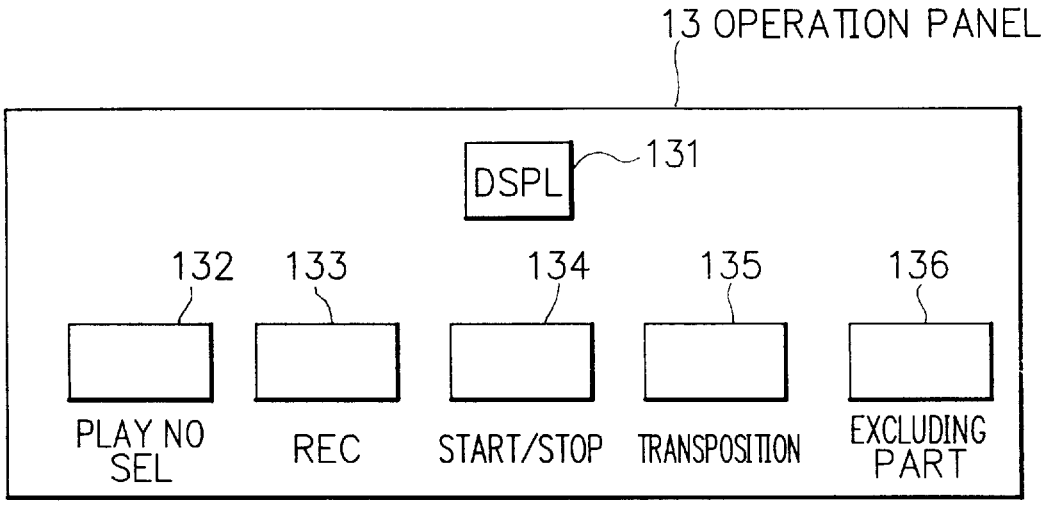
FIG. 3 is a plan view showing an operation panel of the electronic musical instrument to which the present invention is applied.

FIG. 1 is a functional block diagram showing the elementary features of a transposition controller for an electronic musical instrument according to the present invention. FIG. 2 is a schematic block diagram showing the arrangement of the electronic musical instrument. FIG. 3 is a plan view showing an operation panel of the electronic musical instrument.

Referring to FIG. 2, reference numeral 11 denotes one or a plurality of keyboards each including a plurality of keys and key switches arranged in correspondence with the keys. Reference numeral 12 denotes a key scan circuit for detecting the operated key numbers by scanning the ON/OFF states of the keys of the keyboard 11, and detecting the velocity indicating the operation speed (the volume of the tone to be generated) of each key. Normally, the plurality of keys are used for indicating the pitches and timings of tones to be generated or to be turned off.

Reference numeral 13 denotes an operation panel which comprises various operation members such as a play number selection switch 132, a recording switch 133, an auto-play start/stop switch 134, a transposition data set switch 135, a transposition excluding part set switch 136, and the like in addition to a display 131, as shown in FIG. 3. Although not shown in FIG. 3, the operation panel 13 also comprises operation members for setting the rhythm, tone color, tone volume, effect, and the like. FIG. 3 will be described in detail later.

Reference numeral 14 denotes a CPU for controlling the operation of the overall electronic musical instrument using a RAM 16 as a work memory in accordance with a control program stored in a ROM 15. For example, the CPU 14 performs scan processing of the key switches of the keyboard 11 and scan processing of the switches 132 to 136 on the operation panel 13. With this processing, the CPU 14 detects the operation states of the keys (ON keys, OFF keys, the key numbers and velocities of operated keys, and the like), and the operation states of the switches 132 to 136, and executes the individual processing operations (to be described later) in accordance with the operations of the keys or switches.

The ROM 15 stores PCM waveform data and auto-play data used in an auto-play as pre-set data in addition to the control program of the CPU 14. The RAM 16 has storage areas for temporarily storing various necessary data during execution of the program by the CPU 14 and for storing data obtained as a result of various kinds of processing.

More specifically, in this embodiment, the RAM 16 stores:

1. auto-play data
2. transposition data for the entire system set by the transposition data set switch 135
3. transposition excluding part data set by the transposition excluding part set switch 136

The auto-play data per note data (tone data) is stored in the following format:

1st byte: step time indicating tone generation timing

2nd byte: key number

3rd byte: velocity

4th byte: gate time indicating tone generation time (note length)

Reference numeral 17 denotes a tone generation circuit, which comprises a plurality of tone generation channels and can concurrently generate a plurality of tones. With this arrangement, when the player plays a given part with the keyboard 11 while playing back the auto-play data read out from the RAM 16, an ensemble play with a plurality of play parts can be realized.

The tone generation circuit 17 reads out PCM waveform data from the ROM 15 on the basis of key number data indicating the keys supplied from the CPU 14, tone parameter data set upon operation of the individual operation members, and the like, and processes the amplitudes and envelopes of the readout data on the basis of the velocity and gate time. The obtained digital tone data are converted into an analog tone signal by a D/A converter (not shown), and the tone signal is amplified by an amplifier 18. Thereafter, the amplified signal is supplied to a loudspeaker 19.

Reference numeral 20 denotes an external interface which comprises, e.g., a MIDI interface. The external interface 20 exchanges data between the electronic musical instrument of this embodiment and an external device (not shown) in accordance with the MIDI (Musical Instrument Digital Interface) standards as the connection standards between an electronic musical instrument and an external device. With this interface, auto-play data can be input from an external auto-play unit and can be stored in the RAM 16.

Note that the key scan circuit 12, CPU 14, ROM 15, RAM 16, and tone generation circuit 17 are connected to a bus line 21 including a data bus, address bus, and the like to exchange data with each other.

FIG. 3 schematically shows the operation panel 13, the display 131 displays the contents set by the various operation members on the operation panel 13, and the operator can set desired data while observing the display 131. The play number selection switch 132 is used for selecting the play number used in an auto-play.

The recording switch 133 is used for instructing to record auto-play data. When the recording switch 133 is turned on, data played with the keyboard 11 in the ON state is recorded in the RAM 16 (FIG. 2) as auto-play data. Note that the auto-play data may be stored in a floppy disk, hard disk, or the like (not shown). A plurality of auto-play data can be recorded.

The player selects desired one auto-play data among a plurality of auto-play data recorded in the RAM 16 or the floppy disk, hard disk, or the like (not shown), and auto-play data pre-set in the ROM 15 by using the play number selection switch 132.

The auto-play start/stop switch 134 is used for instructing the start or end of an auto-play based on the auto-play data. When the start of the auto-play is instructed, the auto-play data selected by the play number selection switch 132 at that time is read out by the CPU 14 and is supplied to the tone generation circuit 17 after it is subjected to predetermined processing such as transposition processing.

The transposition data set switch 135 is used for setting transposition data for the entire system. When transposition data is set by the transposition data set switch 135, the tones to be generated in all the play parts are transposed by an amount indicated by the set transposition data.

The transposition excluding part set switch 136 is used for setting a play part which is not to be transposed. When the transposition excluding part is set by the transposition excluding part set switch 136, the tones in the transposition excluding part are not transposed although the transposition data for the entire system is set by the transposition data set switch 135.

A transposition data set means 1 shown in FIG. 1 sets the transposition data for the entire system and includes, e.g., the transposition data set switch 135 on the operation panel 13 shown in FIG. 3. A transposition excluding part set means 2 sets the play part which is not to be transposed and includes, e.g., the transposition excluding part set switch 136 on the operation panel 13 shown in FIG. 3.

A transposition control means 3 shown in FIG. 1 controls to transpose the tones of the individual play parts given as auto-play data and play data obtained by the keyboard operation on the basis of the transposition data set by the transposition data set means 1, except for the play part set by the transposition excluding part set means 2. For example, the transposition control means 3 is made up of the CPU 14, ROM 15, and RAM 16 shown in FIG. 2.

More specifically, the transposition control means 3 executes transposition processing in accordance with the transposition data for the entire system set by the transposition data set means 1 if play data (key data including key numbers and tone parameters including play part data) input upon generation of tones based on the auto-play data from the RAM 16 and the play data supplied from either the keyboard 11 or the external interface 20 do not belong to the play part set as the transposition excluding part by the transposition excluding part set means 2. The transposition control means 3 then supplies tone data obtained by the transposition processing to a tone generation unit 4.

On the other hand, if the input play data belong to the play part set as the transposition excluding part by the transposition excluding part set means 2, the transposition control means 3 supplies tone data to the tone generation unit 4 without executing any transposition processing. The tone generation unit 4 is included in the tone generation circuit 17 shown in FIG. 2. The tone generation unit 4 performs processing such as D/A conversion and the like for the tone data input from the transposition control means 3, and outputs the processed data, thereby generating tone signals which are transposed in accordance with the set contents of the transposition data set means 1 and the transposition excluding part set means 2.

Whether or not the play data input to the transposition control means 3 belong to the transposition excluding part set by the transposition excluding part set means 2 is determined by, e.g., comparing the transposition excluding part data stored in the transposition control means 3 (more specifically, the RAM 16 in FIG. 2), and play part data included in tone parameters (e.g., tone generation channel number assigned to auto-play data or play data generated by keyboard operations).

The transposition processing is attained by changing the key number value included in key data in accordance with the set transposition data. More specifically, the value indicated by the transposition data is added to or subtracted from the key number supplied at that time, thereby setting a new key number in correspondence with the operation of the transposition data set means 1 by the operator.

The transposition excluding part set switch 136 shown in FIG. 3 can be a single switch that excludes only the part of play data of the keyboard 11 as the excluding part. When this switch 136 is turned on, play data of the keyboard 11 is subjected to tone generation without undergoing any transposition processing, and other auto-play data, external MIDI data or the like are subjected to tone generation after they undergo transposition processing in accordance with the set transposition data.

Figure 4:
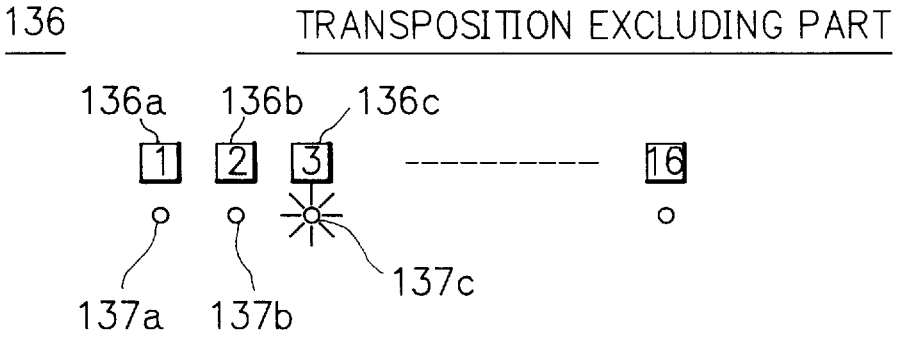
FIG. 4 illustrates the operation panel to show an example of a transposition excluding part set means 2 shown in FIG. 1.

FIG. 4 illustrates the operation panel to show an example of the transposition excluding part set means 2 shown in FIG. 1. In FIG. 4, the operation panel includes 16 switches 136*a*, 136*b*, . . . , which serve as the transposition excluding part set switch 136 in FIG. 3, and LED indicators 137*a*, 137*b*, . . . , which respectively correspond to these switches. The switches 136*a*, 136*b*, . . . correspond to part numbers 1 to 16 or tone generation channel numbers 1 to 16.

For example, when the switch 136*c* corresponding to the third part is pressed to set the part as the transposition excluding part, the corresponding indicator 137*c* is turned on to indicate that the third part is set as the transposition excluding part. Data indicating that the switch 136*c* is pressed is detected by the CPU 14, and is written as the transposition excluding part data in the RAM 16. When the switch 136*c* with the indicator 137*c* ON is pressed once again, the third part is canceled from the transposition excluding part, and the indicator 137*c* is turned off.

Figure 5:
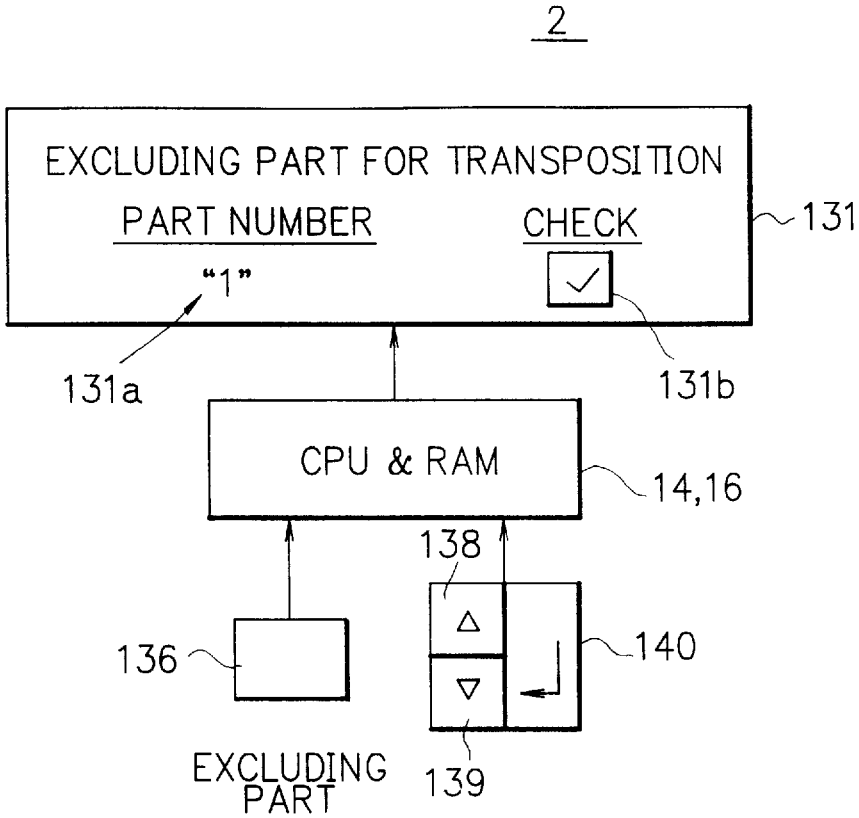
FIG. 5 is a block diagram showing another example of the transposition excluding part set means 2 shown in FIG. 1.

FIG. 5 is a block diagram showing another example of the transposition excluding part set means 2 shown in FIG. 1. The transposition excluding part set means 2 shown in FIG. 5 is made up of the transposition excluding part set switch 136 shown in FIG. 3, an up key 138, a down key 139 and an enter key 140. Such elements are arranged on the operation panel 13, the CPU 14, the RAM 16, and the display 131.

When the transposition excluding part set switch 136 is pressed, the set mode is started, a message "Excluding Part for Transposition" is displayed on the display 131, and a part number 131*a* and a check mark 131*b* are displayed beneath the message. In this mode, by operating the up key 138 and down key 139 on the operation panel 13, the displayed part number 131*a* can be shifted like "1", "2", . . . , and when the enter key 140 is pressed with the desired part number displayed, the check mark 131*b* indicating that the part is set as the transposition excluding part is displayed. When the enter key 140 is pressed once again, the set excluding part is canceled and the check mask 131*b* disappears.

The operations of the switches 136, 138, 139, and 140 are detected by the CPU 14, and the set transposition excluding part number is written in the RAM 16.

When the display 131 has a sufficiently large screen size, all the part numbers can be displayed at the same time. In this case, each part number can be highlight-displayed (e.g., by black-and-white reversal display) upon operation of the up and down keys 138 and 139. When the enter key 140 is pressed at the position of the highlight-displayed part number, the check mark 131*b* is displayed to set the corresponding part as the transposition excluding part. Alternatively, the excluding part may be selected by inputting each part number using a ten-key pad.

Figure 6:
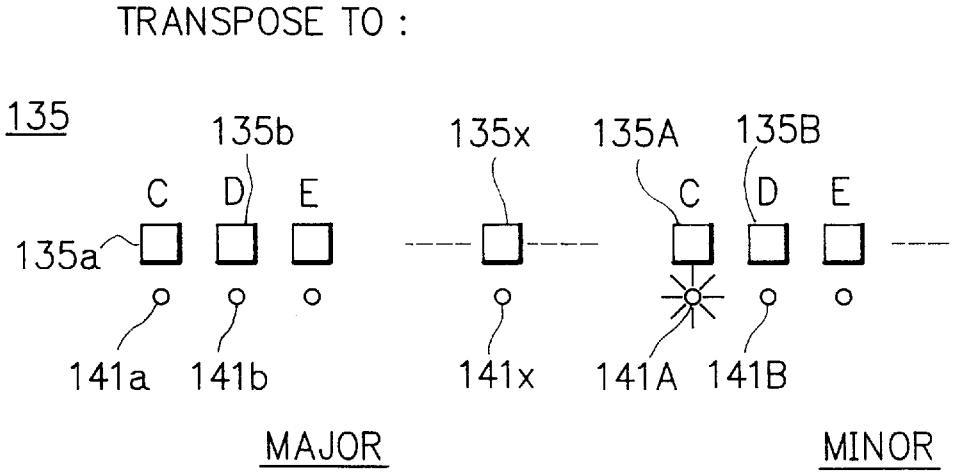
FIG. 6 illustrates the operation panel to show an example of a transposition data set means 1 shown in FIG. 1.

FIG. 6 illustrates the operation panel to show an example of the transposition data set means 1 shown in FIG. 1. In FIG. 6, the operation panel includes, as the transposition data set switch 135 in FIG. 3, switches 135*a*, 135*b*, . . . for setting one of the major keys (C, D, E, . . . ) as the transposition key name, and switches 135A, 135B, . . . for setting one of the minor keys (C, D, E, . . . ) as the transposition key name. LED indicators 141*a*, 141*b*, . . . , and 141A, 141B, . . . are arranged to respectively correspond with these switches.

For example, when the switch 135*a* corresponding to C major is pressed as the transposition key name, the corresponding indicator 141*a* is turned on, thus setting transposition to C major. When another switch 135*x* is pressed, the corresponding indicator 141*x* is turned on, and the indicator 141*a* is turned off.

Figure 7:
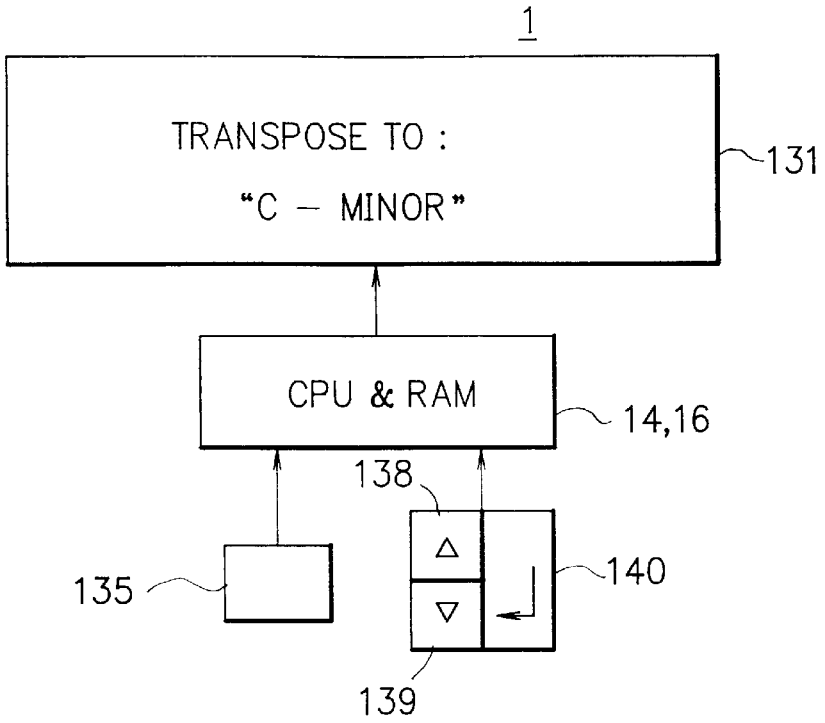
FIG. 7 is a block diagram showing another example of the transposition data set means 1 shown in FIG. 1.

FIG. 7 is a block diagram showing another example of the transposition data set means 1 shown in FIG. 1. The transposition set means 1 shown in FIG. 7 includes the transposition data set switch 135 shown in FIG. 3, an up key 138, a down key 139, an enter key 140 arranged on the operation panel 13, the CPU 14, the RAM 16 and the display 131.

When the transposition data set switch 135 is pressed, the set mode is started, a message "Transpose To:" is displayed on the display 131 and "C-Minor" as the transposition key name is displayed beneath the message. The key name displayed on the display 131 can be shifted in turn by operating the up and down keys 138 and 139 on the operation panel 13. When the enter key 140 is pressed with the desired transposition key name displayed, the CPU 14 recognizes the key name and writes it in the RAM 16. When another key name is displayed by further operating the up and down keys 138 and 139, and the enter key 140 is pressed, the transposition key name "C-Minor" stored in the RAM 16 is canceled and new transposition data is set.

When the display 131 has a sufficiently large screen size, all the transposition data can be simultaneously displayed. In this case, each key name can be highlight-displayed (e.g., by black-and-white reversal display) upon operation of the up and down keys 138 and 139. When the enter key 140 is pressed at the position of the highlight-displayed key name, the transposition data can be set.

The operation of the transposition controller for the electronic musical instrument according to the embodiment of the present invention executed by the CPU 14 will be described in detail below with reference to the flow charts in FIGS. 8 to 11.

Figure 8:
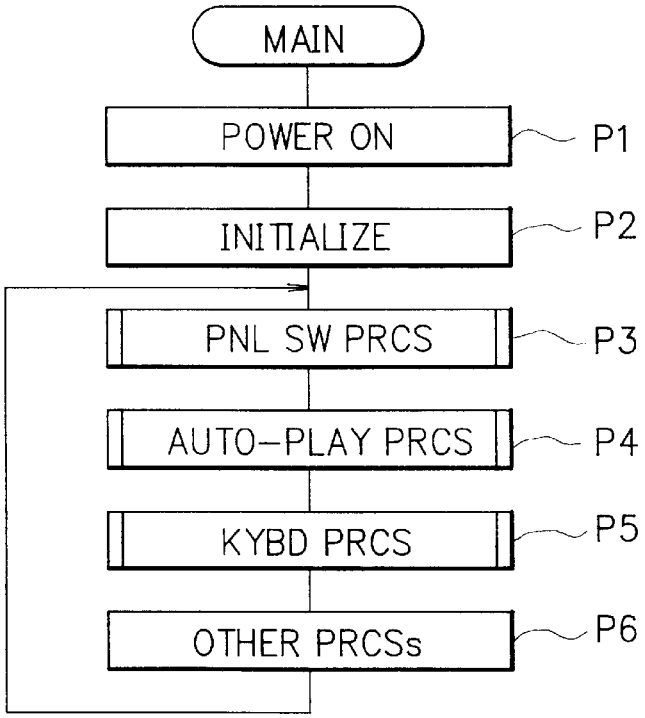
FIG. 8 is a flow chart showing the flow of the overall processing (main routine) of the electronic musical instrument according to an embodiment of the present invention.

FIG. 8 is a flow chart showing the flow of the overall processing (main routine) of the electronic musical instrument.

In FIG. 8, when the power switch of the electronic musical instrument is turned on in step P1, the individual parameters are initialized in step P2. In this case, the storage area in the RAM 16 (FIG. 2) that stores auto-play data, transposition data, and transposition excluding part data is initialized.

Subsequently, in step P3, panel switch processing (scan processing of the operation members on the operation panel 13) is executed. Furthermore, auto-play processing is executed in step P4, and keyboard processing (scan processing of the key switches on the keyboard 11) is executed in step P5. After other processing operations are executed in step P6, the flow returns to step P3.

Figure 9:
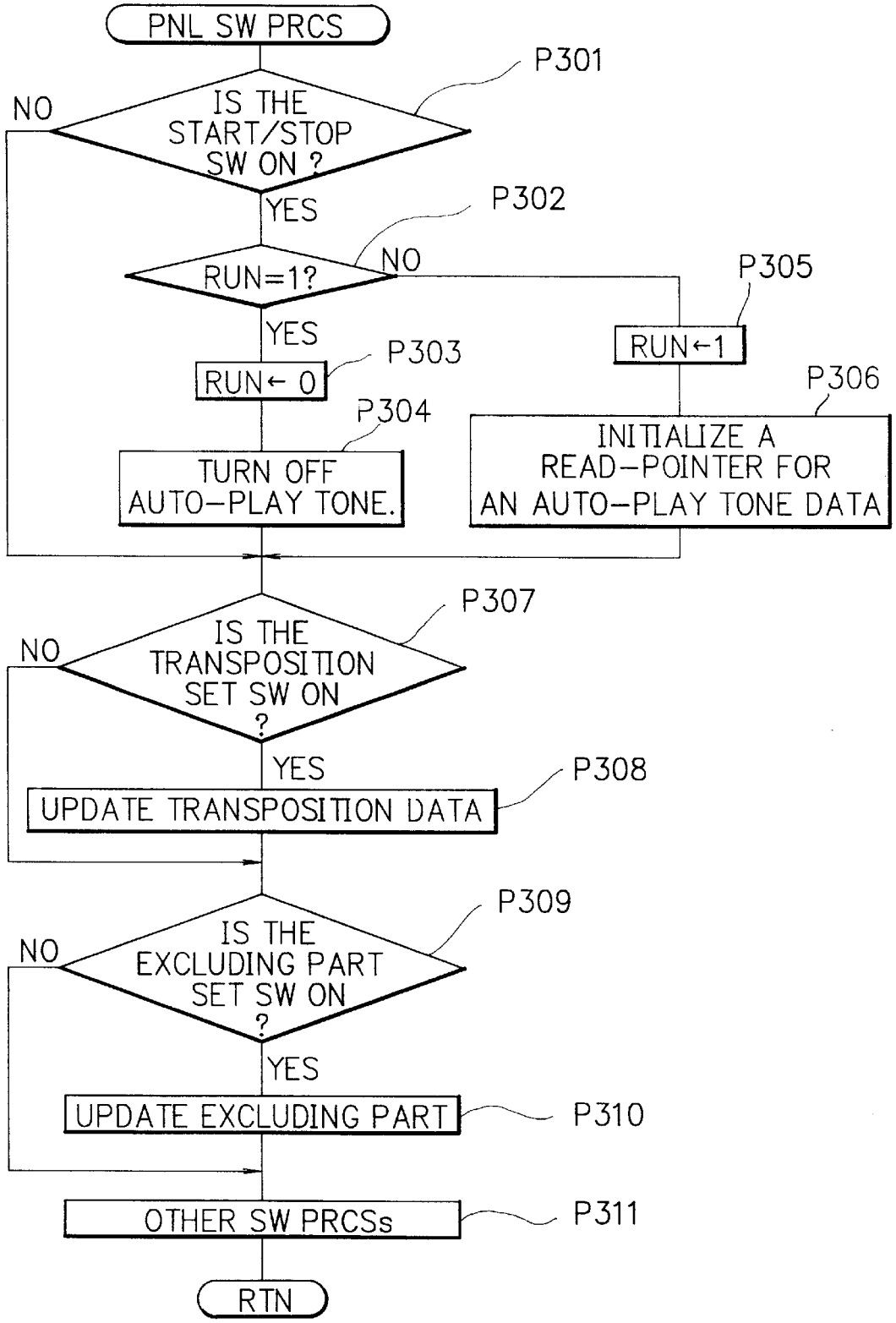
FIG. 9 is a flow chart showing the contents of the panel switch processing.

FIG. 9 is a flow chart showing the contents of the panel switch processing in step P3 in FIG. 8. In this panel switch processing, the control detects whether or not an operation member arranged on the operation panel 13 is operated by the operator. If some event is detected, processing corresponding to the detected event is executed.

Note that the flow chart in FIG. 9 shows the operation upon executing an ensemble play using pre-recorded or pre-set auto-play data, and assumes that desired auto-play data has already been selected by the play number selection switch 132.

In FIG. 9, it is checked in step P301 if the auto-play start/stop switch 134 is turned on. If YES in step P301, the flow advances to step P302; otherwise, the flow jumps to step P307. It is checked in step P302 if the value of a parameter RUN is "1". The parameter RUN indicates if an auto-play is being currently executed. If the value of the parameter RUN is "1", it indicates that an auto-play is being currently executed. If the value is "0", it indicates that an auto-play is not executed.

If it is determined in step P302 that the value of the parameter RUN is "1", the flow advances to step P303 to update the value of the parameter RUN to "0" so as to stop the currently executed auto-play. Thereafter, the tones based on the auto-play data are turned off in step P304. The flow then advances to step P307.

On the other hand, if it is determined in step P302 that the value of the parameter RUN is not "1", the flow advances to step P305 to update the value of the parameter RUN to "1" so as to start an auto-play. Subsequently, in step P306, the read-pointer of the auto-play data selected by the play number selection switch 132 is initialized to prepare for starting an auto-play. The flow then advances to step P307.

It is checked in step P307 if the transposition data set switch 135 is ON. If YES in step P307, the flow advances to step P308, and the transposition data for the entire system stored in the RAM 16 is updated in accordance with the contents set by the transposition data set switch 135. On the other hand, if it is determined in step P307 that the transposition data set switch 135 is not ON, the flow jumps to step P309 without executing the processing in step P308.

It is checked in step P309 if the transposition excluding part set switch 136 is ON. If YES in step P309, the flow advances to step P310, and the transposition excluding part data stored in the RAM 16 is updated in accordance with the contents set by the transposition excluding part set switch 136. On the other hand, if it is determined in step P309 that the transposition excluding part set switch 136 is not ON, the flow jumps to step P311 without executing the processing in step P310.

In step P311, other switch processing operations (including scan processing of the play number selection switch 132, and operation members for setting the rhythm, tone color, tone volume, effect, and the like (not shown)) are executed. Upon completion of the processing in steps P301 to P311 above, the flow returns to the main routine shown in FIG. 8, and the auto-play processing in step P4 is executed.

Figure 10:
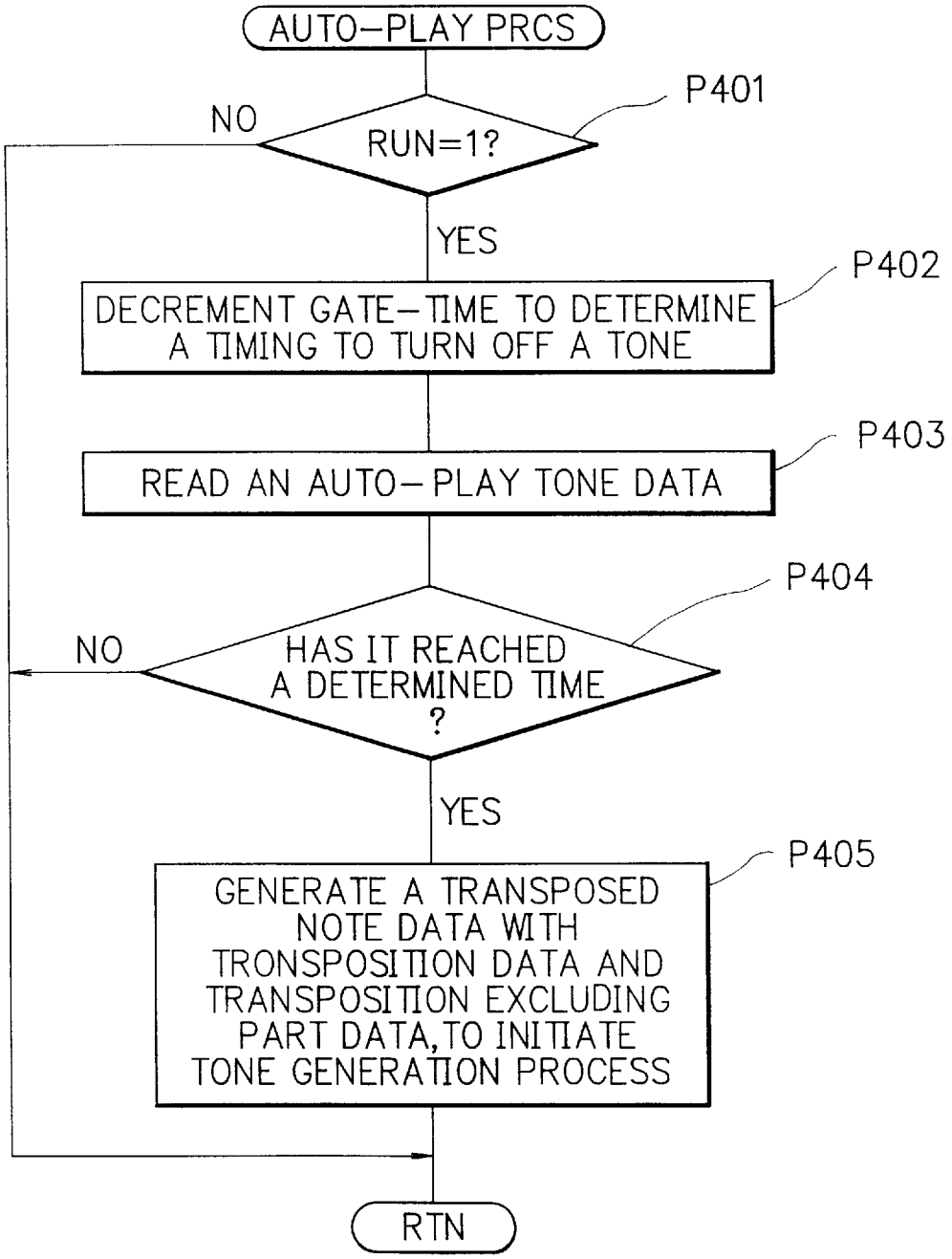
FIG. 10 is a flow chart showing the contents of the auto-play processing.

FIG. 10 is a flow chart showing the contents of the auto-play processing in step P4 in FIG. 8.

In FIG. 10, it is checked in step P401 if the value of the parameter RUN is "1". If YES in step P401, since an auto-play is being currently executed, the flow advances to step P402. On the other hand, if it is determined in step P401 that the value of the parameter RUN is "0", since an auto-play is not performed currently, the flow returns to the main routine shown in FIG. 8 without executing any processing.

In step P402, processing for measuring the gate-time (the note length representing the tone generation time) of note data set as the auto-play data, and turning off a tone that has reached the turn-off timing is executed. In step P403, the next note data of the auto-play data is read. In step P404, it is checked if the read note data has reached the tone generation timing indicated by the step time.

If YES in step P404, the flow advances to step P405, and transposed tone data is generated on the basis of the transposition data and transposition excluding part data set in the RAM 16 at that time to execute tone generation processing. More specifically, when the transposition data for the entire system is set, and the tone generation part of the auto-play data does not correspond to the transposition excluding part, transposition processing is executed in accordance with the set transposition data. At the same time the tone generation circuit 17 executes tone generation processing on the basis of the tone data obtained by the transposition processing.

On the other hand, if the transposition data for the entire system is not set or if the tone generation part of the auto-play data corresponds to the transposition excluding part although the transposition data is set, no transposition processing is executed and the tone generation circuit 17 executes tone generation processing based on the read auto-play data itself.

If it is determined in step P404 that the tone generation timing is not reached yet, the flow returns to the main routine shown in FIG. 8 while skipping the processing in step P405, and the keyboard processing in step P5 is executed.

Figure 11:
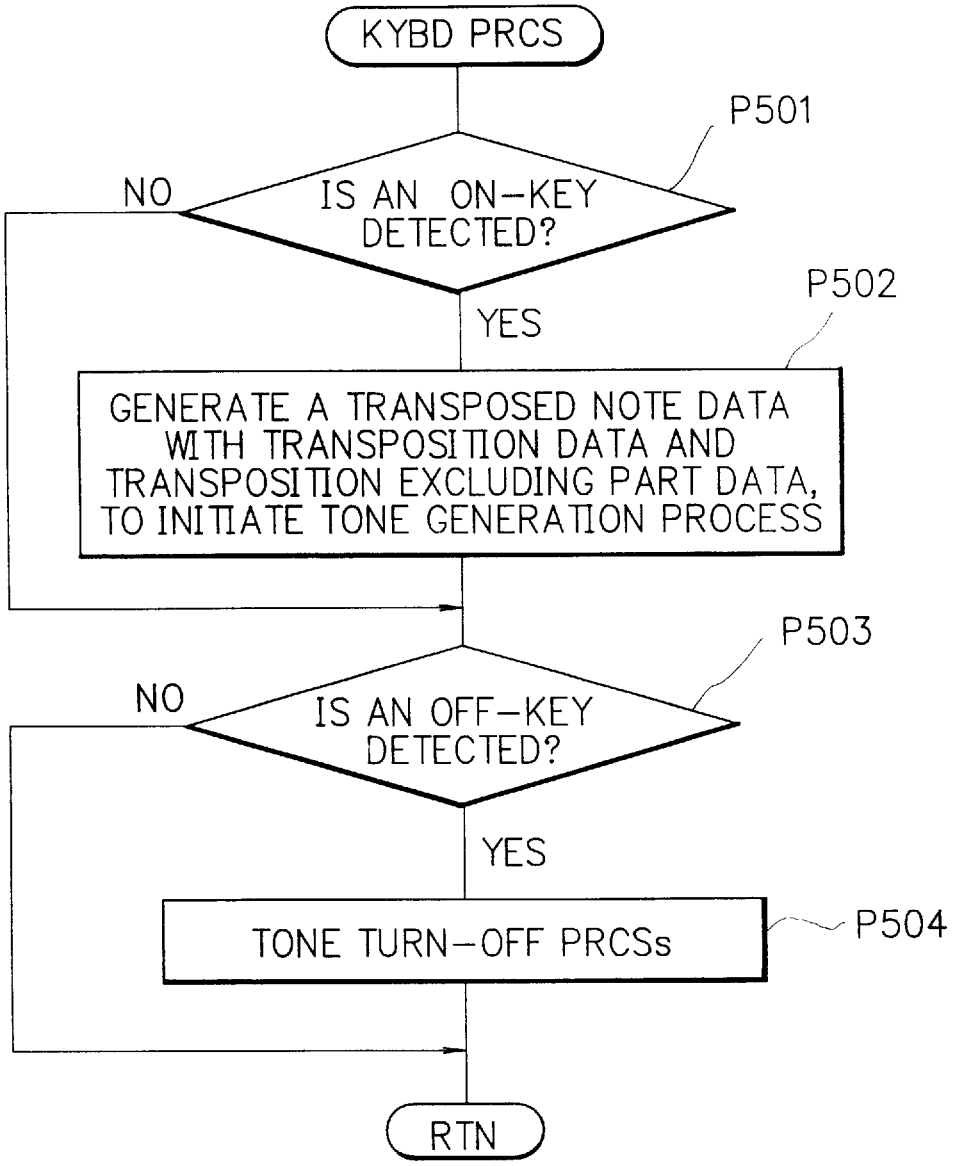
FIG. 11 is a flow chart showing the contents of the keyboard processing.

FIG. 11 is a flow chart showing the contents of the keyboard processing in step P5 in FIG. 8.

In FIG. 11, it is checked in step P501 if an ON-key event is detected. If YES in step P501, the flow advances to step P502; otherwise, the flow jumps to step P503.

In step P502, transposed tone data is generated on the basis of the transposition data and transposition excluding part data set in the RAM 16 at that time, and the tone generation processing is executed. That is, if the transposition data for the entire system is set, and the tone generation part of play data generated by the keyboard operation does not correspond to the transposition excluding part, transposition processing is executed in accordance with the set transposition data. Also, the tone generation circuit 17 executes tone generation processing based on the tone data obtained by the transposition processing.

On the other hand, if the transposition data for the entire system is not set or if the tone generation part of the play data generated by the keyboard operation corresponds to the transposition excluding part although the transposition data is set, no transposition processing is executed, and the tone generation circuit 17 executes tone generation processing based on the tone data itself generated by the keyboard operation. Upon completion of the processing in step P502, the flow advances to step P503.

It is checked in step P503 if an OFF-key event is detected. If YES in step P503, the flow advances to step P504 to execute turn-off processing of the tone corresponding to the OFF-key event. On the other hand, if NO in step P503, the flow returns to the main routine shown in FIG. 8 without executing the processing in step P504 to execute other processing in step P6.

As described above, according to this embodiment, the play part of the keyboard 11 can be set as the transposition excluding part, while the play parts based on auto-play data can be set as transposition parts. Even when the auto-play data is recorded in a key other than the C major key, the auto-play data can be transposed to C major key to generate tones in the playback mode. Since play data generated by the operation of the keyboard 11 is not transposed at that time, the player can easily play the keyboard in C major key to generate tones in C major key.

Therefore, the auto-play data and play data generated by the keyboard operation can be subjected to tone generation in correspondence with C major key independently of the recorded key of the auto-play data. Even a beginner can easily enjoy a musically precise ensemble play in common key.

Contrary to the above-mentioned embodiment, the play part to be transposed exclusively may be selected from various play parts. However, in this case, the play part to be transposed must be individually set, resulting in very complicated setting. In contrast to this, in the above-mentioned embodiment, since the transposition excluding part is set using the transposition excluding part set switch 136, setting is very easy.

As described above, since the present invention comprises the transposition excluding part set means for setting a transposition excluding part of various play parts generated upon executing an ensemble play, and the transposition control means for controlling to transpose only tone data of the play parts except for the play part set by the transposition excluding part set means, tones can be generated by transposing the tone data of other play parts without transposing those of the play part desired by the player. For example, the play parts based on auto-play data can be transposed, and the play part by keyboard operations of the player can be inhibited from being transposed.

With this control, even when auto-play data is recorded in a key other than standard C major key, the auto-play data can be transposed to the C major key to generate tones when it is played back, and the player can easily play the keyboard 11 in the C major key to generate tones without any transposition. Therefore, the auto-play data and play data generated by the keyboard operation can be subjected to tone generation in correspondence with the C major key independently of the recorded key of the auto-play data, and even a beginner can easily enjoy a musically precise ensemble play in common key.

What is claimed is:

1. A transposition controller for an electronic musical instrument which has tone generation channels corresponding to a plurality of parts to attain an ensemble play, comprising:

transposition data set means for setting transposition data for tone data of the individual parts;

part set means for selecting at least one part which is not to be transposed from the plurality of parts; and transposition control means for exclusively performing transposition data processing for the tone data of the parts to be transposed on the basis of the part data set by said part set means and the transposition data set by said transposition data set means.

2. A controller according to claim 1, wherein the part data is tone generation channel data.

3. A controller according to claim 1, wherein said part set means comprises one or a plurality of selection switches which are assigned to part numbers.

4. A controller according to claim 1, wherein said part set means includes a switch which sets a part to which tone data generated by a keyboard operation belong as the part which is not to be transposed.

5. A controller according to claim 4, further comprising:

an auto-play unit for performing an auto-play on the basis of stored auto-play data, and wherein said transposition control means transposes the auto-play data, and does not transpose tone data generated by the keyboard operation.

6. A controller according to claim 1, wherein said part set means comprises display means for sequentially or simultaneously displaying the plurality of parts, and selection means for selecting one or a plurality of ones of the plurality of displayed parts and displaying a selection mark at the display position or positions of the selected part or parts.

7. A controller according to claim 1, wherein said transposition data set means comprises means for presenting a plurality of key names, and means for selecting one of the key names.

* * * * *